US010593190B2

(12) United States Patent
Boettcher et al.

(10) Patent No.: US 10,593,190 B2
(45) Date of Patent: Mar. 17, 2020

(54) SYSTEMS AND METHODS OF PROVIDING STATUS INFORMATION IN A SMART HOME SECURITY DETECTION SYSTEM

(71) Applicant: Google Inc., Mountain View, CA (US)

(72) Inventors: Jesse Boettcher, San Jose, CA (US); David Hendler Sloo, Menlo Park, CA (US); Jeffrey Alan Boyd, Novato, CA (US); Sophie Le Guen, Burlingame, CA (US)

(73) Assignee: GOOGLE LLC, Mountain View, CA (US)

( * ) Notice: Subject to any disclaimer, the term of this patent is extended or adjusted under 35 U.S.C. 154(b) by 0 days.

(21) Appl. No.: 14/585,269

(22) Filed: Dec. 30, 2014

(65) Prior Publication Data

US 2016/0189505 A1 Jun. 30, 2016

(51) Int. Cl.

| | |
|---|---|
| ***G08B 25/14*** | (2006.01) |
| ***G08B 19/00*** | (2006.01) |
| *G08B 25/10* | (2006.01) |

(52) U.S. Cl.

CPC ..... *G08B 25/14* (2013.01); *G08B 19/00* (2013.01); *G08B 25/10* (2013.01)

(58) Field of Classification Search

CPC ..... G08B 13/22; G08B 19/00; G08B 25/14; G08B 25/10

See application file for complete search history.

(56) References Cited

U.S. PATENT DOCUMENTS

| | | | | |
|---|---|---|---|---|
| 4,794,368 | A | 12/1988 | Grossheim et al. | |
| 5,638,046 | A | 6/1997 | Malinowski | |
| 6,144,289 | A | 11/2000 | Le Bel | |
| 6,646,566 | B1 | 11/2003 | Tanguay | |
| 7,339,607 | B2 | 3/2008 | Damabhorn | |
| 7,574,610 | B2 | 8/2009 | Willman et al. | |
| 8,350,694 | B1 * | 1/2013 | Trundle | G08B 25/08 340/539.11 |
| 8,539,567 | B1 | 9/2013 | Logue et al. | |
| 2005/0198063 | A1 | 9/2005 | Thomas et al. | |
| 2011/0254680 | A1 | 10/2011 | Perkinson et al. | |

(Continued)

OTHER PUBLICATIONS

Invitation to Pay Additional Fees and, Where Applicable, Protest Fee issued in PCT/US2015/059981 on Feb. 12, 2016, p. 7.

(Continued)

*Primary Examiner* — Patrick N Edouard
*Assistant Examiner* — Eboni N Giles
(74) *Attorney, Agent, or Firm* — Morris & Kamlay LLP

(57) ABSTRACT

Systems and methods of providing a security system which presents operational status information to a user are disclosed. A sensor can detect a security event and receive identifying information from an electronic device. A controller device is communicatively coupled to the sensor to receive the security event, to determine whether the identifying information detected with the sensor is from the electronic device of an authorized user, and to provide an operational status message to the electronic device via a communications link when it is determined to be authorized. The electronic device provides identifying information to the sensor, receives the operational status message via the communications link, and displays the operational status message.

35 Claims, 5 Drawing Sheets

(56) References Cited

U.S. PATENT DOCUMENTS

| | | | | |
|---|---|---|---|---|
| 2013/0183924 | A1* | 7/2013 | Saigh | A01N 59/00 455/404.2 |
| 2014/0118520 | A1* | 5/2014 | Slaby | G07C 9/00 348/77 |
| 2014/0203904 | A1* | 7/2014 | Fyke | G07C 9/00015 340/5.3 |
| 2014/0266669 | A1 | 9/2014 | Fadell et al. | |
| 2014/0282048 | A1 | 9/2014 | Shapiro | |
| 2015/0052578 | A1* | 2/2015 | Yau | H04W 12/00 726/3 |
| 2015/0269835 | A1* | 9/2015 | Benoit | G08B 25/10 340/539.13 |
| 2015/0325091 | A1* | 11/2015 | Hamilton | G07C 9/00007 340/5.53 |
| 2016/0035196 | A1* | 2/2016 | Chan | G08B 25/008 340/541 |
| 2017/0178489 | A1* | 6/2017 | Thomas | G08B 21/22 |

OTHER PUBLICATIONS

PCT/US2015/059981, International Search Report and Written Opinion issued in PCT/US2015/059981 dated Apr. 22, 2016, dated Apr. 22, 2016, p. 15.

European Examination Report dated Jul. 10, 2018 from EP Application No. 15797571.5, 9 pages.

* cited by examiner

SYSTEMS AND METHODS OF PROVIDING STATUS INFORMATION IN A SMART HOME SECURITY DETECTION SYSTEM

BACKGROUND

Traditional home security systems alert home occupants, owners, and others, such as neighbors and intruders, to the presence of a security event. Such systems typically alert a security company affiliated with the home owner's security system, or local law enforcement authorities. Traditional home security systems typically provide an audible and/or a visual alarm when a security event has been detected.

With traditional home security systems, a home occupant typically has to view a hardware control panel to determine the status of the security system. For example, the home occupant typically has to view the control panel to determine whether the home security system is armed, whether there has been a security event, or whether there is an operational issue with the security system. Although the audible and/or visual alarm will inform a home security system user that a security even has occurred, traditional security systems do not inform the user when the event has occurred, what type of event or violation has occurred, or where in the system the violation or event has occurred. Traditional security systems typically do not identify a member of a household upon returning home, and provide a status of the home security system to that identified household member prior to entry into the home.

BRIEF SUMMARY

According to embodiments of the disclosed subject matter, a user may arrive at a building (e.g., the user's home, office, or the like) having a security system that is disclosed herein, which may identify the user, and provide an operational status message from the security system to the user (e.g., via an electronic device and/or a display) to reassure the user that there has not been a security event and/or environmental at the building while the user has not been present, or provide an operational status message to the user that a security and/or environmental event has occurred. The security system disclosed herein may provide information regarding a source of the security event and/or environmental event, a type of the security event and/or environmental event, a time of the security event and/or environmental event, and a location of the security event and/or environmental event to an electronic device of the user. Alternatively, or in addition, the security system disclosed herein may include a display to display the operational status message to the user when the user has been identified. Alternatively, or in addition, the security system disclosed herein may display an operational status message (e.g., to a display and/or to a user's electronic device) when the user exits the building to inform of the operational state of the security system upon leaving (e.g., the security system is armed and there are no security and/or environmental events detected, there is an operational issued with the system that should be addressed before leaving, and the like).

According to an embodiment of the disclosed subject matter, a security system is provided that includes a sensor to detect a security event and to receive identifying information from an electronic device, a controller device communicatively coupled to the sensor to receive the security event, to determine whether the identifying information detected with the at least one sensor is from the electronic device of an authorized user, and to provide an operational status message to the electronic device via a communications link when it is determined to be authorized and the electronic device to provide identifying information to the sensor, receive the operational status message via the communications link, and display the operational status message.

According to an embodiment of the disclosed subject matter, a method is provided that includes detecting, with a sensor, a security event, receiving, with a controller device communicatively coupled to the sensor, the security event, receiving, with the sensor, identifying information from an electronic device, determining, with the controller device, whether the identifying information detected with the sensor r is from an electronic device of an authorized user, providing, with the controller device, an operational status message to the electronic device via a communications link when it is determined to be authorized, receiving, with the electronic device, the operational status message via the communications link, and displaying, with the electronic device, the operational status message.

According to an embodiment of the disclosed subject matter, means for a security system are provided for detecting, with a sensor, a security event, receiving, with a controller device communicatively coupled to the sensor, the security event, receiving, with the sensor, identifying information from an electronic device, determining, with the controller device, whether the identifying information detected with the sensor is from an electronic device of an authorized user, providing, with the controller device, an operational status message to the electronic device via a communications link when it is determined to be authorized, receiving, with the electronic device, the operational status message via the communications link, and displaying, with the electronic device, the operational status message.

Additional features, advantages, and embodiments of the disclosed subject matter may be set forth or apparent from consideration of the following detailed description, drawings, and claims. Moreover, it is to be understood that both the foregoing summary and the following detailed description are illustrative and are intended to provide further explanation without limiting the scope of the claims.

BRIEF DESCRIPTION OF THE DRAWINGS

The accompanying drawings, which are included to provide a further understanding of the disclosed subject matter, are incorporated in and constitute a part of this specification. The drawings also illustrate embodiments of the disclosed subject matter and together with the detailed description serve to explain the principles of embodiments of the disclosed subject matter. No attempt is made to show structural details in more detail than may be necessary for a fundamental understanding of the disclosed subject matter and various ways in which it may be practiced.

DETAILED DESCRIPTION

Figure 1:
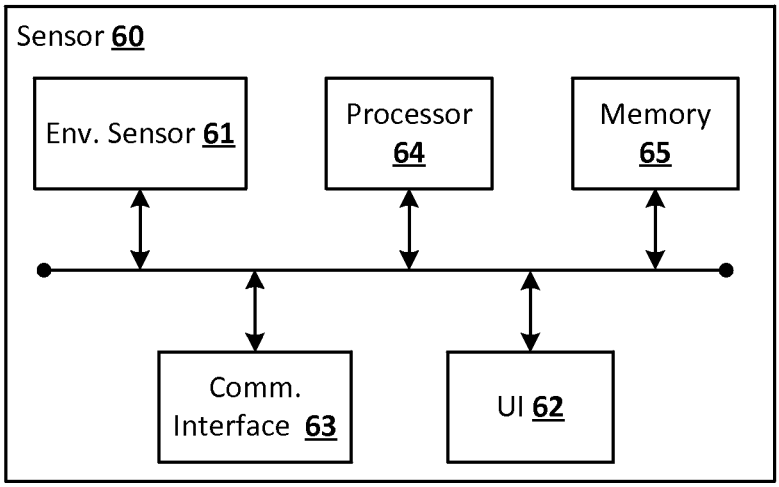
FIG. 1 shows an example sensor according to an embodiment of the disclosed subject matter.

In embodiments of the disclosed subject matter, security systems and methods may identify a user (e.g., an authorized user), and provide an operational status message from the security system to the user (e.g., via an electronic device and/or a display) to reassure the user that there has not been a security event and/or environmental event at a building (e.g., a home, an office, or the like) while the user has not been present, or provide an operational status message to the user that a security and/or environmental event has occurred. The security system and methods disclosed herein may provide information regarding a source of the security event and/or environmental event, a type of the security event and/or environmental event, a time of the security event and/or environmental event, and a location of the security event and/or environmental event to an electronic device of the user. Alternatively, or in addition, the security systems and methods disclosed herein may include a display to display the operational status message to the user when the user has been identified. Alternatively, or in addition, the security system disclosed herein may display an operational status message (e.g., to a display and/or to a user's electronic device) when the user exits the building to inform of the operational state of the security system upon leaving (e.g., the security system is armed and there are no security and/or environmental events detected, and the like).

Embodiments disclosed herein may use one or more sensors. In general, a "sensor" may refer to any device that can obtain information about its environment. Sensors may be described by the type of information they collect. For example, sensor types as disclosed herein may include motion, smoke, carbon monoxide, proximity, temperature, time, physical orientation, acceleration, location, and the like. A sensor can include, for example, a camera, a retinal camera, and/or a microphone.

A sensor also may be described in terms of the particular physical device that obtains the environmental information. For example, an accelerometer may obtain acceleration information, and thus may be used as a general motion sensor and/or an acceleration sensor. A sensor also may be described in terms of the specific hardware components used to implement the sensor. For example, a temperature sensor may include a thermistor, thermocouple, resistance temperature detector, integrated circuit temperature detector, or combinations thereof. In some cases, a sensor may operate as multiple sensor types sequentially or concurrently, such as where a temperature sensor is used to detect a change in temperature, as well as the presence of a person or animal.

In general, a "sensor" as disclosed herein may include multiple sensors or sub-sensors, such as where a position sensor includes both a global positioning sensor (GPS) as well as a wireless network sensor, which provides data that can be correlated with known wireless networks to obtain location information. Multiple sensors may be arranged in a single physical housing, such as where a single device includes movement, temperature, magnetic, and/or other sensors. Such a housing also may be referred to as a sensor or a sensor device. For clarity, sensors are described with respect to the particular functions they perform and/or the particular physical hardware used, when such specification is necessary for understanding of the embodiments disclosed herein.

A sensor may include hardware in addition to the specific physical sensor that obtains information about the environment. FIG. 1 shows an example sensor as disclosed herein. The sensor 60 may include an environmental sensor 61, such as a temperature sensor, smoke sensor, carbon monoxide sensor, motion sensor, accelerometer, proximity sensor, passive infrared (PIR) sensor, magnetic field sensor, radio frequency (RF) sensor, light sensor, humidity sensor, or any other suitable environmental sensor, that obtains a corresponding type of information about the environment in which the sensor 60 is located. A processor 64 may receive and analyze data obtained by the sensor 61, control operation of other components of the sensor 60, and process communication between the sensor and other devices. The processor 64 may execute instructions stored on a computer-readable memory 65. The memory 65 or another memory in the sensor 60 may also store environmental data obtained by the sensor 61. A communication interface 63, such as a Wi-Fi or other wireless interface, Ethernet or other local network interface, or the like may allow for communication by the sensor 60 with other devices.

A user interface (UI) 62 may provide information (e.g., via a display device or the like) and/or receive input from a user of the sensor. The UI 62 may include, for example, a speaker to output an audible alarm and/or message when an event is detected by the sensor 60. The speaker may output a message to an authorized user regarding the operational status (e.g., there are no security and/or environmental events, an operational issue has been detected, and/or a security event and/or environmental event has been detected) of the security system disclosed herein, when, for example, the user arrives at the building (e.g., the user's home, the user's office, or the like), or when the user exits the building. The speaker may output an audible message for a user to access information regarding the operational status of the security system, for example, when the user arrives at the building (e.g., a home, an office, or the like) via an application installed and/or accessible from an electronic device (e.g., device 75 illustrated in FIG. 2B and/or computing device 20 illustrated in FIG. 4, which are discussed in detail below). Alternatively, or in addition, the UI 62 may include a light to be activated when an event is detected by the sensor 60. The user interface may be relatively minimal, such as a limited-output display, or it may be a full-featured interface such as a touchscreen.

Components within the sensor 60 may transmit and receive information to and from one another via an internal bus or other mechanism as will be readily understood by one of skill in the art. One or more components may be implemented in a single physical arrangement, such as where multiple components are implemented on a single integrated circuit. Sensors as disclosed herein may include other components, and/or may not include all of the illustrative components shown.

Sensors as disclosed herein may operate within a communication network, such as a conventional wireless network, and/or a sensor-specific network through which sensors may communicate with one another and/or with dedicated other devices. In some configurations one or more sensors may provide information to one or more other sensors, to a central controller, or to any other device capable of communicating on a network with the one or more sensors. A central controller may be general- or special-purpose. For example, one type of central controller is a home automation network that collects and analyzes data from one or more sensors within the home. Another example of a central controller is a special-purpose controller that is dedicated to a subset of functions, such as a security controller that collects and analyzes sensor data primarily or exclusively as it relates to various security considerations for a location. A central controller may be located locally with respect to the sensors with which it communicates and from which it obtains sensor data, such as in the case where it is positioned within a home that includes a home automation and/or sensor network. Alternatively or in addition, a central controller as disclosed herein may be remote from the sensors, such as where the central controller is implemented as a cloud-based system that communicates with multiple sensors, which may be located at multiple locations and may be local or remote with respect to one another.

Figure 2A:
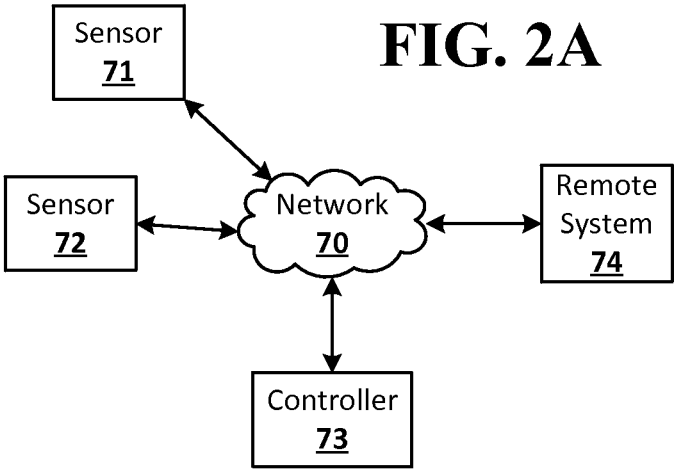
FIGS. 2A-2B show sensor networks of a security system according embodiments of the disclosed subject matter.
Figure 2B:
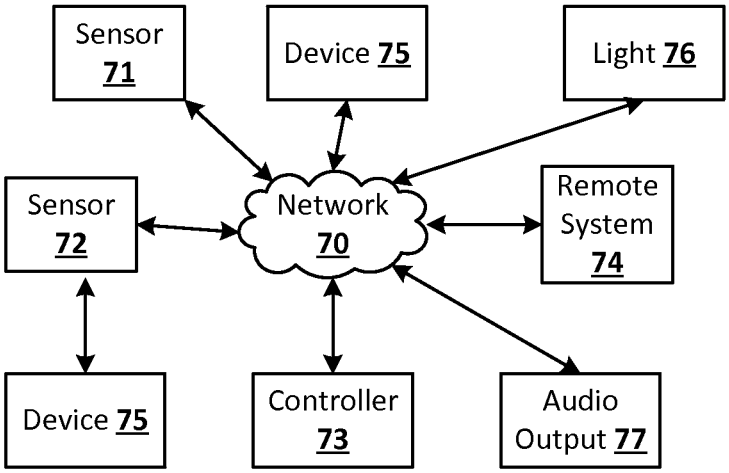

FIGS. 2A-2B show examples of a sensor network of a security system as disclosed herein, which may be implemented over any suitable wired and/or wireless communication networks. One or more sensors 71, 72 may communicate via a local network 70, such as a Wi-Fi or other suitable network, with each other and/or with a controller 73.

FIGS. 2A-2B show examples of a security system as disclosed herein, which may be implemented over any suitable wired and/or wireless communication networks. One or more sensors 71, 72 may communicate via a local network 70, such as a Wi-Fi or other suitable network, with each other and/or with a controller 73. The devices of the security system and smart-home environment of the disclosed subject matter may be communicatively connected via the network 70, which may be a mesh-type network such as Thread, which provides network architecture and/or protocols for devices to communicate with one another. Typical home networks may have a single device point of communications. Such networks may be prone to failure, such that devices of the network cannot communicate with one another when the single device point does not operate normally. The mesh-type network of Thread, which may be used in the security system of the disclosed subject matter, may avoid communication using a single device. That is, in the mesh-type network, such as network 70, there is no single point of communication that may fail so as to prohibit devices coupled to the network from communicating with one another.

The communication and network protocols used by the devices communicatively coupled to the network 70 may provide secure communications, minimize the amount of power used (i.e., be power efficient), and support a wide variety of devices and/or products in a home, such as appliances, access control, climate control, energy management, lighting, safety, and security. For example, the protocols supported by the network and the devices connected thereto may have an open protocol which may carry IPv6 natively.

The Thread network, such as network 70, may be easy to set up and secure to use. The network 70 may use an authentication scheme, AES (Advanced Encryption Standard) encryption, or the like to reduce and/or minimize security holes that exist in other wireless protocols. The Thread network may be scalable to connect devices (e.g., 2, 5, 10, 20, 50, 100, 150, 200, or more devices) into a single network supporting multiple hops (e.g., so as to provide communications between devices when one or more nodes of the network is not operating normally). The network 70, which may be a Thread network, may provide security at the network and application layers. One or more devices communicatively coupled to the network 70 (e.g., controller 73, remote system 74, and the like) may store product install codes to ensure only authorized devices can join the network 70. One or more operations and communications of network 70 may use cryptography, such as public-key cryptography.

The devices communicatively coupled to the network 70 of the smart-home environment and/or security system disclosed herein may low power consumption and/or reduced power consumption. That is, devices efficiently communicate to with one another and operate to provide functionality to the user, where the devices may have reduced battery size and increased battery lifetimes over conventional devices. The devices may include sleep modes to increase battery life and reduce power requirements. For example, communications between devices coupled to the network 70 may use the power-efficient IEEE 802.15.4 MAC/PHY protocol. In embodiments of the disclosed subject matter, short messaging between devices on the network 70 may conserve bandwidth and power. The routing protocol of the network 70 may reduce network overhead and latency. The communication interfaces of the devices coupled to the smart-home environment may include wireless system-on-chips to support the low-power, secure, stable, and/or scalable communications network 70.

The controller 73 shown in FIGS. 2A-2B may be communicatively coupled to the network 70 and may be and/or include a processor. Alternatively, or in addition, the controller 73 may be a general- or special-purpose computer. The controller 73 may, for example, receive, aggregate, and/or analyze environmental information received from the sensors 71, 72. The sensors 71, 72 and the controller 73 may be located locally to one another, such as within a single dwelling, office space, building, room, or the like, or they may be remote from each other, such as where the controller 73 is implemented in a remote system 74 such as a cloud-based reporting and/or analysis system. Alternatively or in addition, sensors may communicate directly with a remote system 74. The remote system 74 may, for example, aggregate data from multiple locations, provide instruction, software updates, and/or aggregated data to a controller 73 and/or sensors 71, 72.

The sensor network shown in FIGS. 2A-2B may be an example of a smart-home environment. The depicted smart-home environment may include a structure, a house, office building, garage, mobile home, or the like. The devices of the smart home environment, such as the sensors 71, 72, the controller 73, and the network 70 may be integrated into a smart-home environment that does not include an entire structure, such as an apartment, condominium, or office space.

The smart home environment can control and/or be coupled to devices outside of the structure. For example, one or more of the sensors 71, 72 may be located outside the structure, for example, at one or more distances from the structure (e.g., sensors 71, 72 may be disposed outside the structure, at points along a land perimeter on which the structure is located, and the like. One or more of the devices in the smart home environment need not physically be within the structure. For example, the controller 73 which may receive input from the sensors 71, 72 may be located outside of the structure.

The structure of the smart-home environment may include a plurality of rooms, separated at least partly from each other via walls. The walls can include interior walls or exterior walls. Each room can further include a floor and a ceiling. Devices of the smart-home environment, such as the sensors 71, 72, may be mounted on, integrated with and/or supported by a wall, floor, or ceiling of the structure.

The smart-home environment including the sensor network shown in FIGS. 2A-2B may include a plurality of devices (e.g., devices 75, sensors 71, 72, and the like), including intelligent, multi-sensing, network-connected devices, that can integrate seamlessly with each other and/or with a central server or a cloud-computing system (e.g., controller 73 and/or remote system 74) to provide home-security and smart-home features. The smart-home environment may include one or more intelligent, multi-sensing, network-connected thermostats (e.g., "smart thermostats"), one or more intelligent, network-connected, multi-sensing hazard detection units (e.g., "smart hazard detectors"), and one or more intelligent, multi-sensing, network-connected entryway interface devices (e.g., "smart doorbells"). The smart hazard detectors, smart thermostats, and smart doorbells may be the sensors 71, 72 and/or device 75 shown in FIGS. 2A-2B.

According to embodiments of the disclosed subject matter, the smart thermostat may detect ambient climate characteristics (e.g., temperature and/or humidity) and may control an HVAC (heating, ventilating, and air conditioning) system accordingly of the structure. For example, the ambient client characteristics may be detected by sensors 71, 72 shown in FIGS. 2A-2B, and the controller 73 may control the HVAC system (not shown) of the structure.

A smart hazard detector may detect the presence of a hazardous substance or a substance indicative of a hazardous substance (e.g., smoke, fire, or carbon monoxide). For example, smoke, fire, and/or carbon monoxide may be detected by sensors 71, 72 shown in FIGS. 2A-2B, and the controller 73 may control an alarm system to provide a visual and/or audible alarm to the user of the smart-home environment. That is, the one or more sensors 71, 72 may be a smoke sensor, a fire sensor, and/or a carbon monoxide sensor that detect an environmental event when smoke, fire, and/or carbon monoxide is sensed.

A smart doorbell may control doorbell functionality, detect a person's approach to or departure from a location (e.g., an outer door to the structure), and announce a person's approach or departure from the structure via audible and/or visual message that is output by a speaker and/or a display coupled to, for example, the controller 73.

In some embodiments, the smart-home environment of the sensor network shown in FIGS. 2A-2B may include one or more intelligent, multi-sensing, network-connected wall switches (e.g., "smart wall switches"), one or more intelligent, multi-sensing, network-connected wall plug interfaces (e.g., "smart wall plugs"). The smart wall switches and/or smart wall plugs may be the sensors 71, 72 and/or device 75 shown in FIGS. 2A-2B. The smart wall switches may detect ambient lighting conditions, and control a power and/or dim state of one or more lights. For example, the sensors 71, 72, may detect the ambient lighting conditions, and the controller 73 may control the power to one or more lights 76 in the smart-home environment. The smart wall switches may also control a power state or speed of a fan, such as a ceiling fan. For example, sensors 72, 72 may detect the power and/or speed of a fan, and the controller 73 may adjusting the power and/or speed of the fan, accordingly. The smart wall plugs may control supply of power to one or more wall plugs (e.g., such that power is not supplied to the plug if nobody is detected to be within the smart-home environment). For example, one of the smart wall plugs may controls supply of power to a lamp (e.g., light 76).

In embodiments of the disclosed subject matter, the smart-home environment may include one or more intelligent, multi-sensing, network-connected entry detectors (e.g., "smart entry detectors"). The sensors 71, 72 shown in FIGS. 2A-2B may be the smart entry detectors. The illustrated smart entry detectors (e.g., sensors 71, 72) may be disposed at one or more windows, doors, and other entry points of the smart-home environment for detecting when a window, door, or other entry point is opened, broken, breached, and/or compromised. The smart entry detectors may generate a corresponding signal to be provided to the controller 73 and/or the remote system 74 when a window or door is opened, closed, breached, and/or compromised. In some embodiments of the disclosed subject matter, the alarm system, which may be included with controller 73 and/or coupled to the network 70 may not arm unless all smart entry detectors (e.g., sensors 71, 72) indicate that all doors, windows, entryways, and the like are closed and/or that all smart entry detectors are armed.

For example, the one or more sensors 71, 72 may be magnetic field sensors that detect a security event when a door and/or window of a building having the security system disclosed herein has been opened and/or compromised. That is, when the sensors 71, 72 detect a door being opened or closed, or being compromised, the security event may be a door event. Similarly, when the sensors 71, 72 detect a window being opened or closed, or being compromised, the security event may be a window event.

The smart-home environment of the sensor network shown in FIGS. 2A-2B may include one or more intelligent, multi-sensing, network-connected doorknobs (e.g., "smart doorknob"). For example, the sensors 71, 72 may be coupled to a doorknob of a door (e.g., doorknobs 122 located on external doors of the structure of the smart-home environment). However, it should be appreciated that smart doorknobs can be provided on external and/or internal doors of the smart-home environment.

The smart thermostats, the smart hazard detectors, the smart doorbells, the smart wall switches, the smart wall plugs, the smart entry detectors, the smart doorknobs, the keypads, and other devices of the smart-home environment (e.g., as illustrated as sensors 71, 72 and/or device 75 of FIGS. 2A-2B can be communicatively coupled to each other via the network 70, and to the controller 73 and/or remote system 74) to provide security, safety, and/or comfort for the smart home environment.

A user can interact with one or more of the network-connected smart devices (e.g., using device 75 communicatively coupled to the network 70). For example, a user can communicate with one or more of the network-connected smart devices using a computer (e.g., a desktop computer, laptop computer, tablet, or the like) or other portable electronic device (e.g., a smartphone, a tablet, a key FOB, and the like). A webpage or application can be configured to receive communications from the user via device 75 and control the one or more of the network-connected smart devices (e.g., sensors 71, 72 and/or device 75) based on the communications and/or to present information about the device's operation to the user. For example, the user can view can arm or disarm the security system (e.g., included with controller 73) of the home.

One or more users can control one or more of the network-connected smart devices in the smart-home environment using a network-connected computer or portable electronic device (e.g., device 75 shown in FIG. 2B). In some examples, some or all of the users (e.g., individuals who live in the home) can register their mobile device and/or key FOBs (e.g., device 75) with the smart-home environment (e.g., with the controller 73). Such registration can be made at a central server (e.g., the controller 73 and/or the remote system 74) to authenticate the user and/or the electronic device as being associated with the smart-home environment, and to provide permission to the user to use the electronic device to control the network-connected smart devices and the security system of the smart-home environment. A user can use their registered electronic device (e.g., device 75) to remotely control the network-connected smart devices (e.g., sensors 71, 72, and/or device 75) and security system of the smart-home environment, such as when the user is at work or on vacation. The user may also use their registered electronic device to control the network-connected smart devices when the user is located inside the smart-home environment.

Alternatively, or in addition to registering electronic devices, the smart-home environment may make inferences about which individuals live in the home and are therefore users and which electronic devices (e.g., device 75) are associated with those individuals. As such, the smart-home environment "learns" who is a user (e.g., an authorized user) and permits the electronic devices associated with those individuals to control the network-connected smart devices of the smart-home environment (e.g., devices communicatively coupled to the network 70). Various types of notices and other information may be provided to users via messages sent to one or more user electronic devices. For example, the messages can be sent via email, short message service (SMS), multimedia messaging service (MMS), unstructured supplementary service data (USSD), as well as any other type of messaging services and/or communication protocols.

The smart-home environment may include communication with devices outside of the smart-home environment but within a proximate geographical range of the home. For example, the smart-home environment may include an outdoor lighting system (e.g., light 76 shown in FIG. 2B) that communicates information through the communication network 70 or directly to a central server or cloud-computing system (e.g., controller 73 and/or remote system 74) regarding detected movement and/or presence of people, animals, and any other objects and receives back commands for controlling the lighting accordingly.

The controller 73 and/or remote system 74 can control the outdoor lighting system according to information received from the other network-connected smart devices in the smart-home environment. For example, in the event, any of the network-connected smart devices, such as smart wall plugs located outdoors, detect movement at night time, the controller 73 and/or remote system 74 can activate the outdoor lighting system and/or other lights in the smart-home environment.

In embodiments of the disclosed subject matter, the remote system 74 may be a law enforcement provider system, a home security provider system, a medical provider system, and/or a fire department provider system. When a security event and/or environmental event is detected by at least one of one sensors 71, 72, a message may be transmitted to the remote system 74. The content of the message may be according to the type of security event and/or environmental event detected by the sensors 71, 72. For example, if smoke is detected by one of the sensors 71, 72, the controller 73 may transmit a message to the remote system 74 associated with a fire department to provide assistance with a smoke and/or fire event (e.g., request fire department response to the smoke and/or fire event). Alternatively, the sensors 71, 72 may generate and transmit the message to the remote system 74. In another example, when one of the sensors 71, 72 detects a security event, such a window or door of a building being compromised (e.g., a window event or a door event, respectively), a message may be transmitted to the remote system 74 associated with local law enforcement to provide assistance with the security event (e.g., request a police department response to the security event).

The controller 73 and/or the remote system 74 may include a display to present an operational status message (e.g., a security event, an environmental event, an operational condition, or the like), according to information received from at least one or the sensors 71, 72. For example, the display of the controller 73 and/or remote system 74 may display the operational status message to a user while the user is away from the building having the security system disclosed herein. Alternatively, or in addition, the controller 73 may display the operational status message to a user when the user arrives at and/or departs (i.e., exits) from the building. For example, one or more sensors may identify and authenticate the user, and the security system may display the operational status message.

FIG. 2B shows a sensor network of a security system as disclosed herein that includes a light 76 and an audio output device 77 that may be controlled, for example, by controller 73. The light 76 may be activated by the controller 73 so as to be turned when one or more sensors 71, 72 detect a security event and/or an environmental event. Alternatively, or in addition, the light 76 may be turned on and off in a pattern (e.g., where the light is turned on for one second, and off for one second; where the light is turned on for two seconds, and off for one second, and the like) when one or more sensors 71, 72 detect a security event and/or an environmental event. Alternatively, or in addition, the audio output device 77 may include at least a speaker to output an audible alarm when a security event and/or an environmental event is detected by the one or more sensors 71, 72. For example, a security event may be when one or more sensors 71, 72 are motion sensors that detect motion either inside a building having the security system disclosed herein, or within a predetermined proximity to the building. The speaker may also output an audible message for a user to access information regarding the operational status of the security system via an application installed and/or accessible from an electronic device. The speaker may, for example, output a message when the user arrives at the building or departs from the building according to the operational status of the security system (e.g., a security and/or environmental event has been detected, an operational issue with the security system has been detected, the security system has been armed and/or disarmed, or the like).

FIG. 2B shows a device 75 that may be communicatively coupled to a sensor. Although FIG. 2B illustrates that device 75 is coupled to sensor 72, the device 75 may be communicatively coupled to sensor 71 and/or sensor 72. The device 75 may be a computing device and/or key FOB as respectively shown in FIGS. 4-5, and discussed below. A user of the security system disclosed herein may control the device 75. When the device 75 is within a predetermined distance (e.g., one foot, five feet, 10 feet, 20 feet, 100 feet, or the like) from the sensor 72, the device 75 and the sensor 72 may communicate with one another via Bluetooth signals, Bluetooth Low Energy (BTLE) signals, Wi-Fi pairing signals, near field communication (NFC) signals, radio frequency (RF) signals, infra-red signals, and/or short-range communication protocol signals. The device 75 may provide identifying information to the sensor 72, which may be provided to the controller 73 to determine whether the device 75 belongs to an authorized user of the security system disclosed herein. When the sensor 72 and/or the controller 73 determine that the device 75 is associated with an authorized user according to the transmitted identification information, the sensor 72 and/or the controller 73 provide an operational status message to the device 75.

In FIGS. 2A-2B, the sensor 71, 72 may be a camera to capture an image of a face of a person to be transmitted to the controller 73, where the controller 73 compares the captured facial image with a pre-stored image. When it is determined by the controller 73 that at least a portion of the captured facial image matches the pre-stored image, the controller 73 determines that the person is an authorized user of the security system disclosed herein.

The sensor 71, 72 may be a camera to capture a retinal image from a person to be transmitted to the controller 73, where the controller 73 compares the captured retinal image with a pre-stored image. When it is determined by the controller 73 that at least a portion of the captured retinal image matches the pre-stored image, the controller 73 determines that the person is an authorized user of the security system disclosed herein.

The sensor 71, 72 may be a microphone to capture a voice of a person to be transmitted to the controller 73, where the controller 73 compares the captured voice with a pre-stored voice. When it is determined by the controller 73 that at least a portion of the captured voice matches the pre-stored voice, the controller 73 determines that the person is an authorized user of the security system disclosed herein.

More generally, the sensor 71, 72 may be any sensor capable of obtaining identifying information about a user, which can be used to determine whether the user is an authorized user by comparison to known information about the user.

When the sensor 72 and/or the controller 73 determine that the device 75 is associated with an authorized user according to the transmitted identification information, the sensor 72 and/or the controller 73 provide an operational status message to the user via a speaker (i.e., audio output 77), a display (e.g., where the display is coupled to the controller 73 and/or remote system 74), and/or the device 75. The operational status message displayed can include, for example, a message that a security event and/or environmental event has occurred. When the sensors 71, 72 have not detected a security and/or environmental event, a message may be displayed that no security and/or environmental event has occurred. In embodiments of the disclosed subject matter, the operational status message displayed (e.g., by the device 75, a display coupled to the controller 74 and/or remote system 74, and the like) may be a visual indicator representing a status of the security system. For example, the display may be use the color green to indicate that no security and/or environmental events have occurred. This displayed color may reassure an authorized user of the security system that there are no security and/or environmental events. The display of the device 75 may use the color yellow to indicate that a particular type of security and/or environmental event has occurred which does not place the authorized user in danger of a particular security and/or environmental hazard. The color yellow may also indicate that one or more of the sensors 71, 72 is not operating normally, or is not being provided sufficient power (e.g., the sensor may have a low battery). The color yellow may also indicate other operational issues of the security system disclosed herein. The display may use the color red to indicate a type of security and/or environmental event presents a threat to the safety and/or health of a user. In embodiments of the disclosed subject matter herein, the display may include green, yellow, and red lights to indicate the operational status of the security system disclosed herein, such as the particular type of security and/or environmental event has occurred.

In embodiments of the disclosed subject matter, the device 75 may be communicatively coupled to the network 70 so as to exchange data, information, and/or messages with the sensors 71, 72, the controller 73, and the remote system 74.

In embodiments of the subject matter disclosed herein, the device 75 may display a source of the security event and/or environmental event, a type of the security event and/or environmental event, a time of the security event and/or environmental event, and a location of the security event and/or environmental event.

In embodiments of the disclosed subject matter, the controller 73 can request entry of an access code from the device 75 and/or a keypad communicatively coupled to the controller 73. Upon receipt of the access code, the security system disclosed herein may be disarmed, and/or may provide an operational status message to the user via a display coupled to the controller 73 and/or the device 75. Alternatively, or in addition, an operational status message may be output via a speaker with the audio output 77.

The controller 75 can transmit a message to the electronic device (e.g., device 75) when a security event and/or environmental event is detected that requests that the user access an application (e.g., from the device 75) to display security event and/or environmental event information. The application may access the controller 73 and/or the remote system 74 to receive operational status information of the security system. The operational status information can include the information discussed above, such as a green, yellow, or red condition state. Alternatively, or in addition, the application can provide a source of the security event and/or environmental event, a type of the security event and/or environmental event, a time of the security event and/or environmental event, a location of the security event and/or environmental event, or any other information regarding the operational status or a detected event by the security system.

Figure 3:
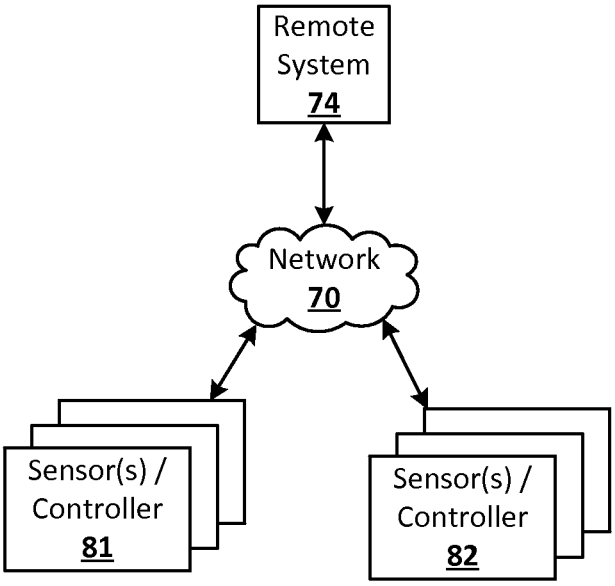
FIG. 3 shows a remote system to aggregate data from multiple locations having security systems according to an embodiment of the disclosed subject matter.

In some configurations, as illustrated in FIG. 3, a remote system 74 may aggregate data from multiple locations, such as multiple buildings, multi-resident buildings, and individual residences within a neighborhood, multiple neighborhoods, and the like. In general, multiple sensor/controller systems 81, 82 as previously described with respect to FIGS. 2A-2B may provide information to the remote system 74. The systems 81, 82 may provide data directly from one or more sensors as previously described, or the data may be aggregated and/or analyzed by local controllers such as the controller 73, which then communicates with the remote system 74. The remote system may aggregate and analyze the data from multiple locations, and may provide aggregate results to each location. For example, the remote system 74 may examine larger regions for common sensor data or trends in sensor data, and provide information on the identified commonality or environmental data trends to each local system 81, 82.

For example, remote system 74 may gather and/or aggregate security event and/or environmental event data from systems 81, 82, which may be geographically proximally located to the security system illustrated in FIGS. 2A-2B. The systems 81, 82 may be located within one-half mile, one mile, five miles, ten miles, 20 miles, 50 miles, or any other suitable distance from the security system of a user, such as the security system shown in FIGS. 2A-2B. The remote system 74 may provide at least a portion of the gathered and/or aggregated data to the controller 73 and/or the device 75 illustrated in FIG. 2B.

The user of the device 75 may receive information from the controller 73 and/or the remote system 74 regarding a security event that is geographically proximally located to the user of the device 75 and/or the security system of a building (e.g., a home, office, or the like) associated with the user. Alternatively, or in addition, an application executed by the device 75 may provide a display of information from systems 81, 82, and/or from the remote system 74.

For example, an unauthorized entry to a building associated with systems 81, 82 may occur, where the building is within one-half mile from the building associated with the user of the device 75. The controller 73 and/or the remote system 74 may transmit a message (e.g., a security alert message) to the device 75 that an unauthorized entry has occurred in a nearby building, thus alerting the user to security concerns and/or potential security threats regarding their geographically proximally located building.

In another example, a smoke and/or fire event of a building associated with systems 81, 82 may occur, where the building is within 500 feet from the building associated with the user of the device 75. The controller 73 and/or the remote system 74 may transmit a message (e.g., a hazard alert message) to the device 75 that the smoke and/or fire event has occurred in a nearby building, thus alerting the user to safety concerns, as well as potential smoke and/or fire damage to their geographically proximally located building.

In embodiments of the disclosed subject matter, the controller 73 and/or the remote system 74 shown in FIGS. 2B-3 can create neighborhood security networks and transmit security-related notifications to homes in the created neighborhoods. The controller 73 and/or the remote system 74 may obtains geographic location data for a plurality of smart-home environments. For example, as shown in FIG. 3, the remote system 74 may obtain geographic location data from systems 81, 82. The remote system 74 may assign the smart-home environments into neighborhood security networks based at least in part on the geographic locations of the homes. For example, homes in close proximity are grouped into the same "neighborhood." In some embodiments, when a home is assigned to a neighborhood, an "opt out" or "opt in" message can be sent to the home, giving its users the option of not participating in the neighborhood or giving them the option of participating.

The remote system 74 may monitor the created neighborhood for security event and/or environmental events. For example, the remote system 74 may analyze data received from the network-connected smart devices of a plurality of smart-home environments. The remote system 74 may apply security-related algorithms, logic, and artificial intelligence to review data received from network-connected smart devices to detect security events, such as home invasions. The remote system 74 may detect a security event and/or environmental event in one of the smart-home environments. For example, the remote server 74 may receive data from sensors 71, 72 that a window has been opened while the occupants are asleep and the home's security system is armed. The remote system 74 may send a security-condition notice to network-connected smart devices in other homes in the same neighborhood. For example, if the remote system 74 infers that the opened window indicates that a home invasion is occurring, it sends a home-invasion alarm to the other houses in the neighborhood. Responsive to detecting the security event in the one of the homes and/or responsive to sending the security-related notifications, the remote system 74 adjusts one or more alarm conditions in the other homes in the neighborhood and/or invokes precautionary responses in the other homes in the neighborhoods. For example, the alarm conditions can be adjusted to increase sensitivity for detecting conditions related to the security notification. In one example, the security notification relates to a home invasion in one home in the neighborhood, the remote system 74 can increase the sensitivity of the sensors 71, 72, turns on the light 76, and locks the smart doorknobs of other houses in the neighborhood.

Figure 4:
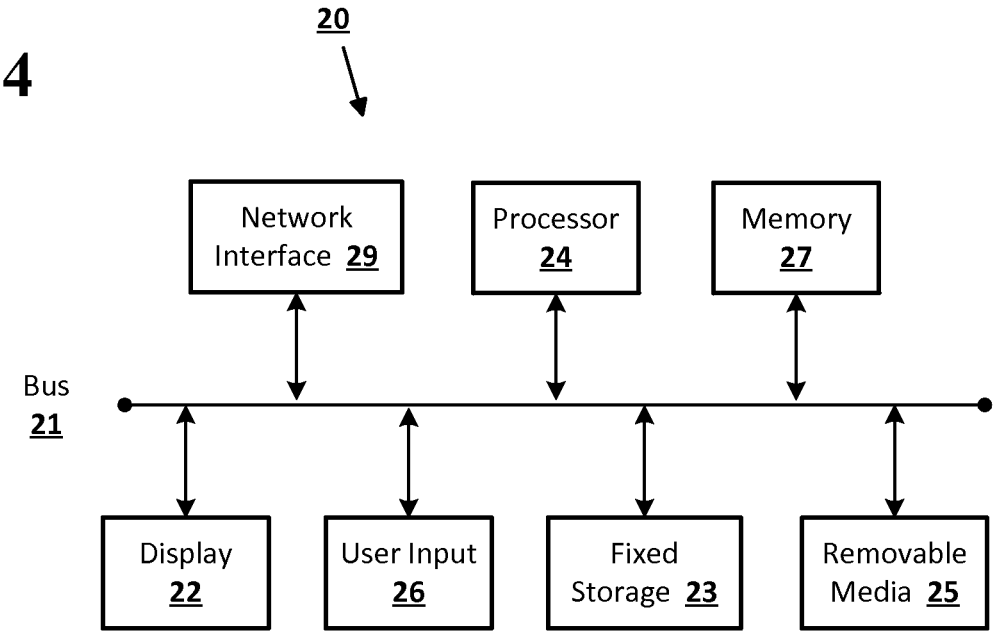
FIGS. 4-5 show electronic devices according to embodiments of the disclosed subject matter.

Embodiments of the presently disclosed subject matter may be implemented in and used with a variety of computing devices. FIG. 4 is an example computing device 20 suitable for implementing embodiments of the presently disclosed subject matter. The computing device may be the device 75 illustrated in FIG. 2B and discussed above. The device 20 may be used to implement a controller, a device including sensors as disclosed herein, or the like. Alternatively or in addition, the device 20 may be, for example, a desktop or laptop computer, or a mobile computing device such as a smart phone, tablet, key FOB, or the like. The device 20 may include a bus 21 which interconnects major components of the computer 20, such as a central processor 24, a memory 27 such as Random Access Memory (RAM), Read Only Memory (ROM), flash RAM, or the like, a user display 22 such as a display screen and/or lights (e.g., green, yellow, and red lights, such as light emitting diodes (LEDs) to provide the operational status of the security system to the user, as discussed above), a user input interface 26, which may include one or more controllers and associated user input devices such as a keyboard, mouse, touch screen, and the like, a fixed storage 23 such as a hard drive, flash storage, and the like, a removable media component 25 operative to control and receive an optical disk, flash drive, and the like, and a network interface 29 operable to communicate with one or more remote devices via a suitable network connection.

The bus 21 allows data communication between the central processor 24 and one or more memory components 25, 27, which may include RAM, ROM, and other memory, as previously noted. Applications resident with the computer 20 are generally stored on and accessed via a computer readable storage medium.

The fixed storage 23 may be integral with the computer 20 or may be separate and accessed through other interfaces. The network interface 29 may provide a direct connection to a remote server via a wired or wireless connection. The network interface 29 may provide a communications link with the network 70, sensors 71, 72, controller 73, and/or the remote system 74 as illustrated in FIGS. 2A-2B. The network interface 29 may provide such connection using any suitable technique and protocol as will be readily understood by one of skill in the art, including digital cellular telephone, radio frequency (RF), Wi-Fi, Bluetooth®, Bluetooth Low Energy (BTLE), near-field communications (NFC), and the like. For example, the network interface 29 may allow the device to communicate with other computers via one or more local, wide-area, or other communication networks, as described in further detail herein.

Figure 5:
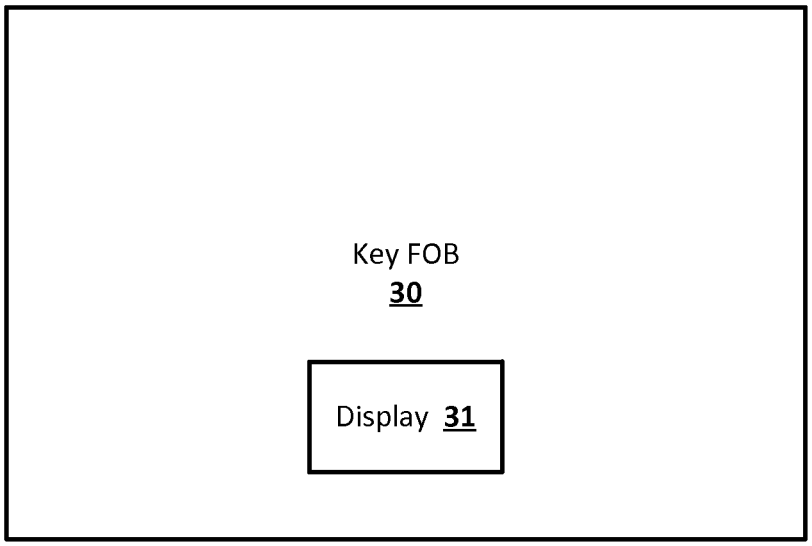

FIG. 5 shows a key FOB 30 having a display 31 according to an embodiment of the disclosed subject matter. The key FOB 30 may be device 75 illustrated in FIG. 2B which may, for example, communicate with sensors 71, 72, as discussed in detail above. Alternatively, or in addition, the key FOB 30 may communicate with the controller 73 via the network 70.

For example, the display 31 of the device 30 may be include a plurality of lights (e.g., light emitting diodes (LEDs), including green, yellow, and red lights. The display 31 may illuminate the green light to indicate that no security and/or environmental events have occurred. This displayed color may reassure an authorized user of the security system that there are no security and/or environmental events. The display 31 of the device 30 may use the yellow light to indicate that a particular type of security and/or environmental event has occurred that is not place the authorized user in danger of a particular security and/or environmental hazard. The yellow light may also indicate that one or more of the sensors 71, 72 is not operating normally, or is not being provided sufficient power (e.g., the sensor may have a low battery). The display 31 of the device 30 may use the red light to indicate a type of security and/or environmental event presents a threat to the safety and/or health of a user.

Figure 6:
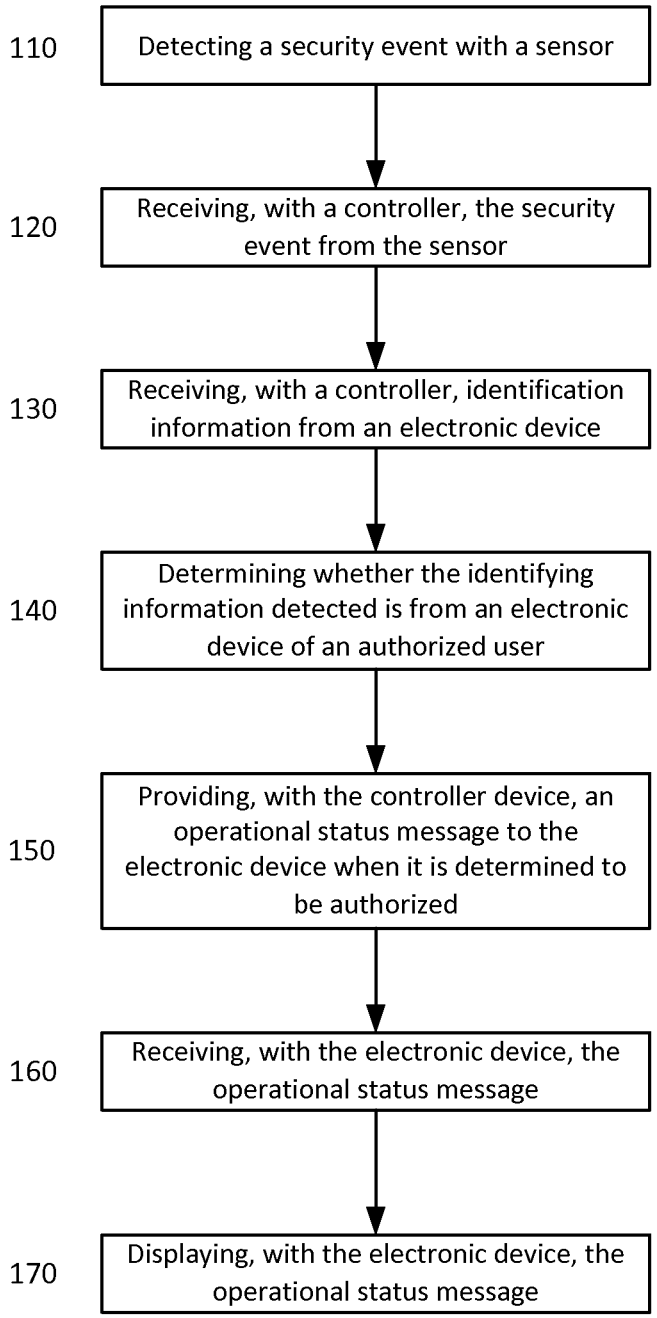
FIG. 6 shows example operations of a security method according to an embodiment of the disclosed subject matter.

FIG. 6 shows example operations of a security method 100 according to an embodiment of the disclosed subject matter. In operation 110, a sensor (e.g., sensors 71, 72 illustrated in FIGS. 2A-2B) can detect a security event. A controller, such as controller 73 illustrated in FIGS. 2A-2B that is communicatively coupled to the sensor, can receive the security event from the sensor in operation 120. The sensor can receive identifying information from an electronic device (e.g., device 75 illustrated in FIG. 2B and/or computing device 20 illustrated in FIG. 4) at operation 130. A controller device (e.g., the controller 73 illustrated in FIGS. 2A-2B) determines whether the identifying information detected with the sensor is from an electronic device of an authorized user at operation 140. At operation 150, the controller device provides an operational status message to the electronic device via a communications link, when the electronic device is determined to be an authorized device (e.g., a device being operated by an authorized user). The electronic device can receive the operational status message via the communications link at operation 160, and display the message on, for example, a display portion of the electronic device, at operation 170. A display may be coupled to the controller device, and may display the operational status message.

In situations in which the systems discussed here collect personal information about users, or may make use of personal information, the users may be provided with an opportunity to control whether programs or features collect user information (e.g., a user's current location, a location of the user's house or business, or the like), or to control whether and/or how to receive content from the content server that may be more relevant to the user. In addition, certain data may be treated in one or more ways before it is stored or used, so that personally identifiable information is removed. For example, specific information about a user's residence may be treated so that no personally identifiable information can be determined for the user, or a user's geographic location may be generalized where location information is obtained (such as to a city, ZIP code, or state level), so that a particular location of a user cannot be determined. As another example, systems disclosed herein may allow a user to restrict the information collected by those systems to applications specific to the user, such as by disabling or limiting the extent to which such information is aggregated or used in analysis with other information from other users. Thus, the user may have control over how information is collected about the user and used by a system as disclosed herein.

Various embodiments of the presently disclosed subject matter may include or be embodied in the form of computer-implemented processes and apparatuses for practicing those processes. Embodiments also may be embodied in the form of a computer program product having computer program code containing instructions embodied in non-transitory and/or tangible media, such as hard drives, USB (universal serial bus) drives, or any other machine readable storage medium, such that when the computer program code is loaded into and executed by a computer, the computer becomes an apparatus for practicing embodiments of the disclosed subject matter. When implemented on a general-purpose microprocessor, the computer program code may configure the microprocessor to become a special-purpose device, such as by creation of specific logic circuits as specified by the instructions.

Embodiments may be implemented using hardware that may include a processor, such as a general purpose microprocessor and/or an Application Specific Integrated Circuit (ASIC) that embodies all or part of the techniques according to embodiments of the disclosed subject matter in hardware and/or firmware. The processor may be coupled to memory, such as RAM, ROM, flash memory, a hard disk or any other device capable of storing electronic information. The memory may store instructions adapted to be executed by the processor to perform the techniques according to embodiments of the disclosed subject matter.

The foregoing description, for purpose of explanation, has been described with reference to specific embodiments. However, the illustrative discussions above are not intended to be exhaustive or to limit embodiments of the disclosed subject matter to the precise forms disclosed. Many modifications and variations are possible in view of the above teachings. The embodiments were chosen and described in order to explain the principles of embodiments of the disclosed subject matter and their practical applications, to thereby enable others skilled in the art to utilize those embodiments as well as various embodiments with various modifications as may be suited to the particular use contemplated.

The invention claimed is:

1. A security system comprising:

a sensor to detect a security event and to receive identifying information from an electronic device when the electronic device is within a predetermined distance from the sensor;

a controller device communicatively coupled to the sensor to receive the security event, to determine whether the identifying information detected is from the electronic device of an authorized user, and to transmit an operational status message based on a type of the received security event to the electronic device via a communications link when the electronic device is determined to be authorized; and the electronic device to provide identifying information to the sensor, receive the operational status message via the communications link, and display the operational status message on a display of the electronic device when the electronic device is detected to be within the predetermined distance from the sensor and the electronic device is determined to be authorized, wherein the security event is the type of event that is displayed by the operational status message when the electronic device is detected to be within a predetermined distance from the sensor and the electronic device is determined to be authorized, and is not displayed by the operational status message when the electronic device is not within the predetermined distance from the sensor.

2. The system of claim 1, wherein the security event from the sensor is from a group consisting of: a door event, a window event, a motion detection event within a predetermined distance from the sensor, and an environmental event.

3. The system of claim 1, wherein the sensor, when a security event is detected, provides to the controller device at least one from the group consisting of: a source of the security event, a time of the security event, and a location of the security event.

4. The system of claim 1, wherein the electronic device is selected from the group consisting of: a smartphone, a tablet device, and a key fob.

5. The system of claim 1, wherein the communications link between the sensor and the electronic device is from the group consisting of Bluetooth signals, Bluetooth Low Energy (BTLE) signals, Wi-Fi pairing signals, near field communication (NFC) signals, radio frequency (RF) signals, infra-red signals, and short-range communication protocol signals.

6. The system of claim 1, wherein the sensor comprises a camera to capture an image of a face of a person to be transmitted to the controller device, and wherein the controller device compares the captured facial image with a pre-stored image, and when it is determined that at least a portion of the captured facial image matches the pre-stored image, the controller device determines that the person is the authorized user.

7. The system of claim 1, wherein the sensor comprises a microphone to capture a voice of a person to be transmitted to the controller device, and wherein the controller device compares the captured voice with a pre-stored voice, and when it is determined that at least a portion of the captured voice matches the pre-stored voice, the controller device determines that the person is the authorized user.

8. The system of claim 1, wherein the at least one of a plurality of sensors comprises a camera to capture a retinal image from a person to be transmitted to the controller device, and wherein the controller device compares the captured retinal image with a pre-stored image, and when it is determined that at least a portion of the captured retinal image matches the pre-stored image, the controller device determines that the person is the authorized user.

9. The system of claim 1, wherein the operational status message displayed by the electronic device is selected from the group consisting of: a message that the security event that has occurred, and a message that no security event has occurred.

10. The system of claim 9, wherein the displayed message indicates at least one from the group consisting of: a source of the security event, the type of the security event, a time of the security event, and a location of the security event.

11. The system of claim 1, wherein the operational status message displayed by the electronic device is a visual indicator representing a status of the security system.

12. The system of claim 1, wherein the controller device, via the communications link, requests entry of an access code that is selected from the group consisting of: the electronic device and a keypad communicatively coupled to the controller device.

13. The system of claim 1, wherein the controller device transmits a message to the electronic device when the security event is detected that requests that the user to access an application to display security event information.

14. The system of claim 1, further comprising:

a speaker, communicatively coupled to the control device, to output an audible message or audible alarm according to the received security event from the sensor.

15. The system of claim 14, further comprising:

the speaker to output an audible message for the user to access security event information from an application.

16. The system of claim 1, wherein the electronic device, via an application, displays information of law-enforcement activity for a predetermined area proximate to the security system.

17. The system of claim 1, wherein the electronic device, via an application, displays information from security systems for a predetermined area proximate to the security system.

18. The system of claim 1, further comprising:

a display coupled to the controller device to display the operational status message.

19. A method comprising:

detecting, with a sensor, a security event;

receiving, by a controller device communicatively coupled to the sensor, the security event from the sensor;

receiving, by the sensor, identifying information from an electronic device when the electronic device is within a predetermined distance from the sensor;

determining, by the controller device, whether the identifying information detected with the sensor is from an electronic device of an authorized user;

transmitting, by the controller device, an operational status message based on a type of the received security event to the electronic device via a communications link when the electronic device is determined to be authorized;

receiving, by the electronic device, the operational status message via the communications link; and displaying, by a display of the electronic device, the operational status message when the electronic device is detected to be within the predetermined distance from the sensor and the electronic device is determined to be authorized, wherein the security event is the type of event that is displayed by the operational status message when the electronic device is detected to be within a predetermined distance from the sensor and the electronic device is determined to be authorized, and is not displayed by the operational status message when the electronic device is not within the predetermined distance from the sensor.

20. The method of claim 19, wherein the detecting the security event comprises:

detecting the security event from a group consisting of: a door event, a window event, a motion detection event within a predetermined distance from the at least one of the plurality of sensors, and an environmental event.

21. The method of claim 19, wherein the providing the operational status message comprises:

providing at least one from the group consisting of: a source of the security event, a time of the security event, and a location of the security event.

22. The method of claim 19, wherein the detecting the security event comprises:

capturing, by the sensor, an image of a face of a person to be transmitted to the controller device;

comparing, by the controller device, the captured facial image with a pre-stored image; and determining that the person is the authorized user when it is determined that at least a portion of the captured facial image matches the pre-stored image.

23. The method of claim 19, wherein the detecting the security event comprises:

capturing, by the sensor, a voice of a person to be transmitted to the controller device;

comparing, by the controller device, the captured voice with a pre-stored voice; and determining that the person is the authorized user when it is determined that at least a portion of the captured voice matches the pre-stored voice.

24. The method of claim 19, wherein the detecting the security event comprises:

capturing, by the sensor, a retinal image from a person to be transmitted to the controller device;

comparing, by the controller device, the captured retinal image with a pre-stored image; and determining that the person is the authorized user when it is determined that at least a portion of the captured retinal image matches the pre-stored image.

25. The method of claim 19, wherein the operational status message displayed by the electronic device is selected from the group consisting of: a message that the security event that has occurred, and a message that no security event has occurred.

26. The method of claim 19, wherein the displaying the operational status message comprises:

displaying the operational status message that is selected from the group consisting of: a message that the security event that has occurred, and a message that no security event has occurred.

27. The method of claim 26, wherein the displayed message indicates at least one from the group consisting of: a source of the security event, the type of the security event, a time of the security event, and a location of the security event.

28. The method of claim 19, wherein the displaying the operational status message comprises:

displaying a visual indicator representing a status of the security system.

29. The method of claim 19, further comprising:

requesting, by the controller, entry of an access code that is selected from the group consisting of: the electronic device and a keypad communicatively coupled to the controller device.

30. The method of claim 19, further comprising:

wherein the controller device transmits a message to the electronic device when the security event is detected that requests that the user to access an application to display security event information.

31. The method of claim 19, further comprising:

transmitting, by the controller device, a message to the electronic device when the security event is detected that requests that the user to access an application to display security event information.

32. The method of claim 19, further comprising:

outputting, by a speaker, an audible message for the user to access security event information from an application.

33. The method of claim 19, further comprising:

displaying, by the electronic device, information of law-enforcement activity for a predetermined area proximate to the security system via an application.

34. The method of claim 19, further comprising:

displaying, by the electronic device, information from security systems for a predetermined area proximate to the security system via an application.

35. The method of claim 19, wherein the security event is detected while the authorized user is absent from a premises monitored by a system comprising the sensor, and the predetermined distance is a distance indicating that the authorized user has returned to the premises.

* * * * *